United States Patent [19]

Schoenleber

[11] Patent Number: 4,936,769

[45] Date of Patent: Jun. 26, 1990

[54] ENVELOPE WRAPPERS WITH INSERTS

[76] Inventor: Donald Schoenleber, 55 Gristmill Dr., Belle Mead, N.J. 08502

[21] Appl. No.: 153,464

[22] Filed: Feb. 4, 1988

Related U.S. Application Data

[63] Continuation of Ser. No. 923,230, Oct. 27, 1986, abandoned.

[51] Int. Cl.[5] ..... B65D 27/00

[52] U.S. Cl. ..... 229/92.1; 229/92.8; 229/92; 229/68 R; 229/92.3

[58] Field of Search ..... 229/68 R, 70, 72, 71, 229/87 R, 92, 92.1, 92.3, 92.7, 92.8

[56] References Cited

U.S. PATENT DOCUMENTS 4,473,153 9/1984 Colangelo ..... 229/68 R

*Primary Examiner*—Willis Little

*Attorney, Agent, or Firm*—Shlesinger & Myers

[57] ABSTRACT

An envelope wrapper assembly has a wrapper with a pocket formed by a narrow width pocket panel and a large width central panel, the pocket having adhesive strips at the lateral edges thereof and holding inserts which are readily visible when the flap is opened and the flap inner surface containing printed material data.

6 Claims, 2 Drawing Sheets

FIGURE 6
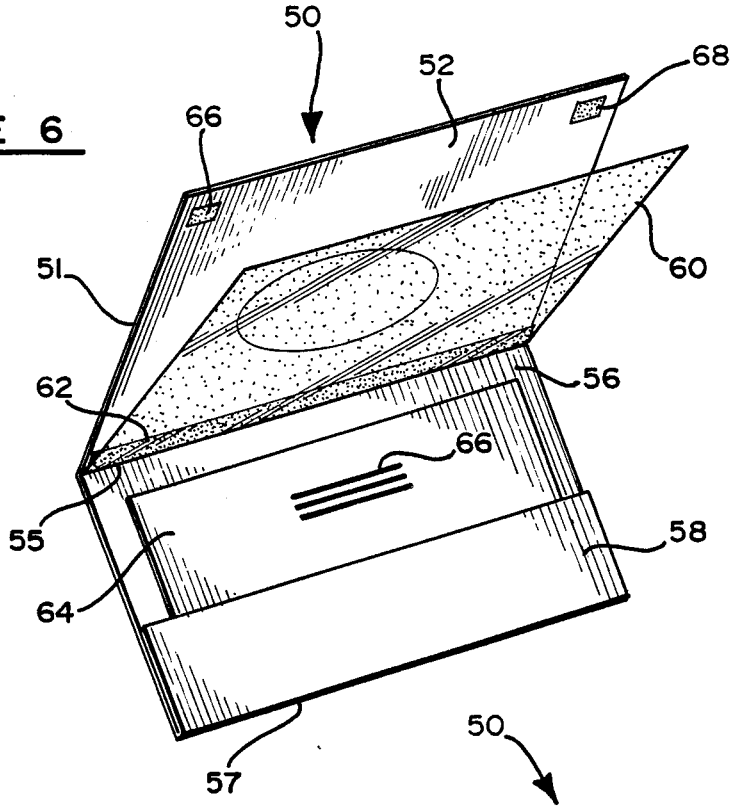
FIGURE 8
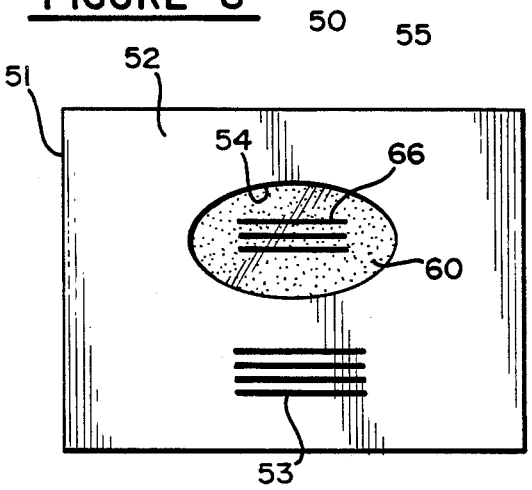
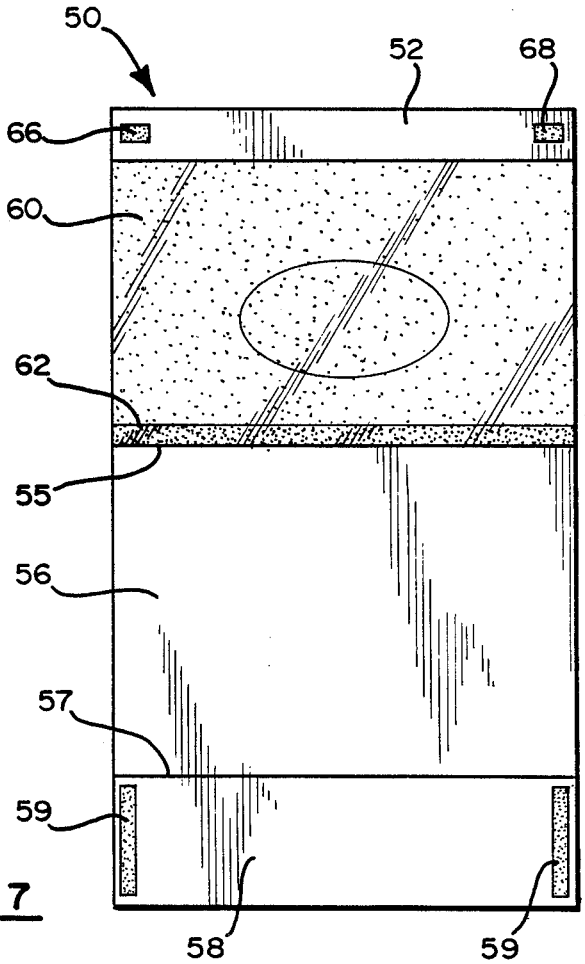
FIGURE 7

ENVELOPE WRAPPERS WITH INSERTS

This application is a continuation of application Ser. No. 923,230, filed Oct. 27, 1986, now abandoned.

BACKGROUND OF THE INVENTION

This invention relates to an envelope wrapper assembly, and particularly to an assembly which has readily removable inserts integrally formed therewith.

With the large growth of the mail and circular type of advertising items which are distributed on a large scale, economy of manufacture, and use of maximum surface area for the advertising message, for a given piece have become important factors in the industry.

It is also highly advantages to an advertiser to provide a packet containing inserts, and which when opened immediately provides a highly prominent advertising message, and prominent display of insert pieces.

SUMMARY OF THE INVENTION

Accordingly, it is an object of this invention to provide an envelope wrapper assembly which is constructed to provide greater advertising and display capability than previous types of envelope assemblies.

It is also an object and feature of this invention to provide a new type of envelope and wrapper assembly in which an arrangement of the elements of the wrapper and inserts provide substantially increased printing surface area which is readily viewed by the user and which contains prominent advertising material.

The envelope wrapper assembly of the instant invention by reason by its construction and arrangement of elements makes possible a highly visible advertising message, and a construction which also provides a highly visible arrangement of contents when the wrapper is opened. In addition, because of the construction of the wrapper, and the arrangement of the inserts, it is possible to include such inserts by mechanical in-line processes, and avoid manual stuffing of a wrapper pocket. Ordinarily, conventional mechanical stuffing equipment cannot be used for this type of wrapper configuration, since the envelope panels are not of equal width.

These and other objects and advantages of the invention will be readily apparent in view of the following description and drawings of the above described invention.

DESCRIPTION OF THE DRAWINGS

FIG. 6 is a perspective view of a further modification of the envelope wrapper assembly of FIG. 1.

FIG. 7 is a plan view of the envelope wrapper of the assembly of FIG. 6 shown in an opened flat position.

FIG. 8 is a plan view of the folded wrapper assembly of FIG. 6.

DESCRIPTION OF THE INVENTION

Figure 1:
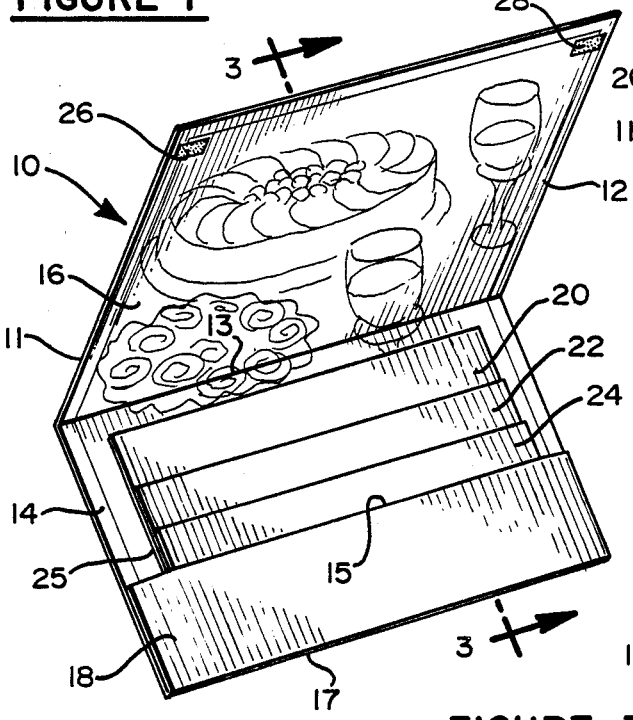
FIG. 1 is a perspective view of an envelope wrapper insert assembly.
Figure 2:
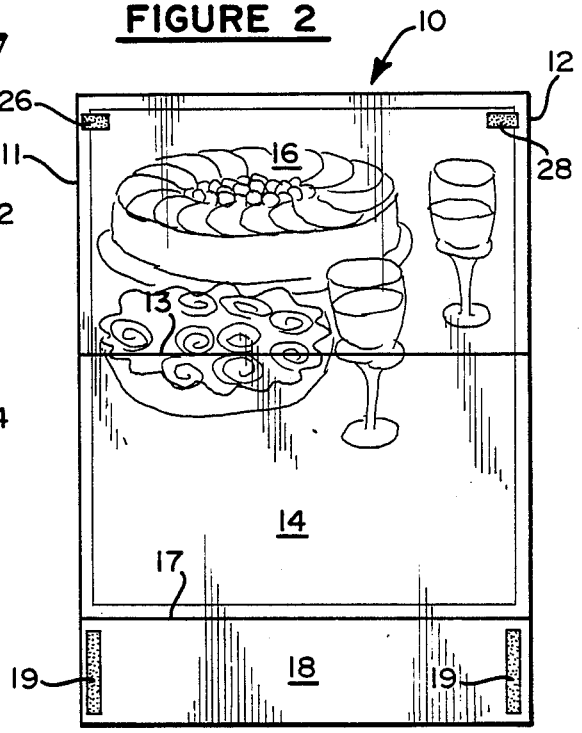
FIG. 2 is a plan view of the envelope wrapper of FIG. 1 disposed in an open flat position.
Figure 3:
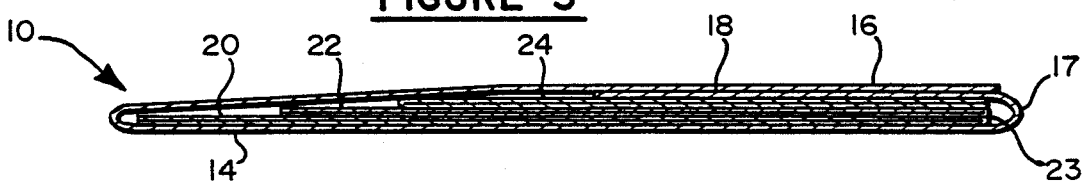
FIG. 3 is a central cross-sectional view of the closed wrapper assembly.

Referring to FIGS. 1 to 3, an envelope wrapper assembly having an outer wrapper generally indicated at 10 has two parallel side edges 11 and 12. It forms an envelope-like wrapper having a central panel 14, a flap panel 16, and a pocket panel 18.

The central panel 14 and the flap panel 16 are of substantially the same width and are joined along their length along a common edge by fold line 13 which forms the upper peripheral edge of the folded envelope wrapper assembly.

The central panel 14 is connected along its length at one side by fold line 17 to pocket panel 18. The central panel is substantially wider transversely (i.e. in height) than the pocket panel 18 and they are joined to each other along their respective portions of the wrapper side edges 11 and 12 by adhesive strips 19 to form an insert retaining pocket.

Printing material is placed on the inside surface of the wrapper 10 and covers the inside surfaces of the panel 16 and a portion of panel 14.

Two printed inserts having sheets 20, 22, and 24, are shown within the insert retaining pocket, each are of a different width to display portions of each page when contained within the pocket panel. A single sheet piece 24, and a double sheet insert having pages 22 and 24 joined at a common fold line 23, are shown.

The envelope assembly is closed when the flap 16 is folded down and adhesive elements 26 and 28 seal the flap against the outer surface of the pocket panel 18 to close the wrapper and hold the inserts in position within the pocket.

This assembly provides the advantage of permitting printing on the inside flap surface and also on the inside surface of central panel of the envelope wrapper. Ordinarily, envelopes have two closed panels of equal width and a narrow width flap, rather than the full panel width of the flap 12 of the wrapper of FIG. 1.

The changing of these dimensions permits the advertiser to gain additional advertising and printing space on the envelope wrapper ordinarily unavailable in a conventional envelope panel. It also provides a readily visible format for the inserts contained within the wrapper. These inserts are readily observable when the wrapper is lifted, as contrasted to an ordinary type envelope in which the inserts are not visible until they are actually removed from between the two envelope panels.

Inasmuch as the pocket panel does not extend up toward and close to the fold line 15, inserts cannot be placed in the wrapper by conventional mechanical stuffers. However, because of the wrapper pocket construction, in-line fabrication permits this drawback to be overcome.

It should also be noted that the side edges 25 of the insert pieces have a clearance from the ends of the pocket defined by the adhesive strips 19 so that these inserts when placed on the wrapper before it is folded do not engage and stick to the glue strips 19.

Figure 4:
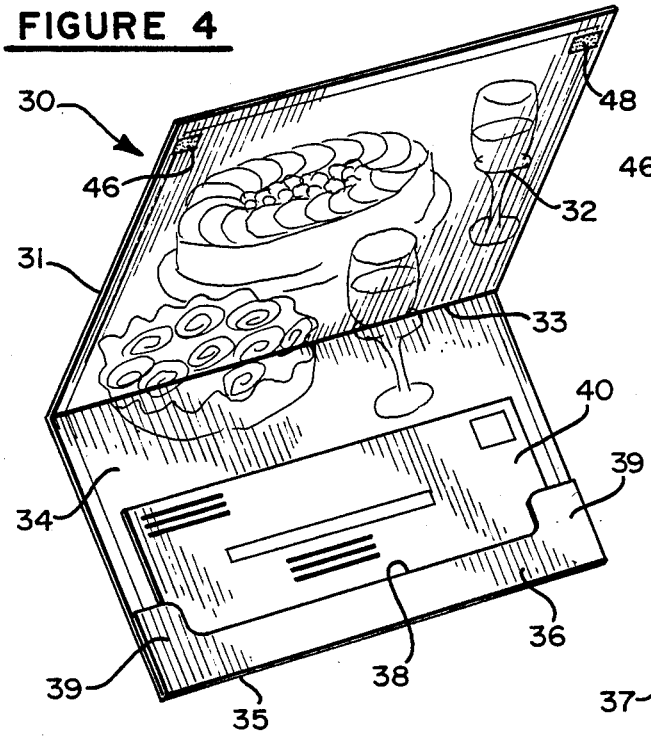
FIG. 4 is a perspective view of a modification of the envelope wrapper assembly of FIG. 1 in which the pocket panel is undercut.

A modification of the above-described envelope wrapper assembly of FIGS. 1 to 3 is shown in FIG. 4, in which the wrapper provides greater viewability for the printed surface of the insert piece.

Figure 5:
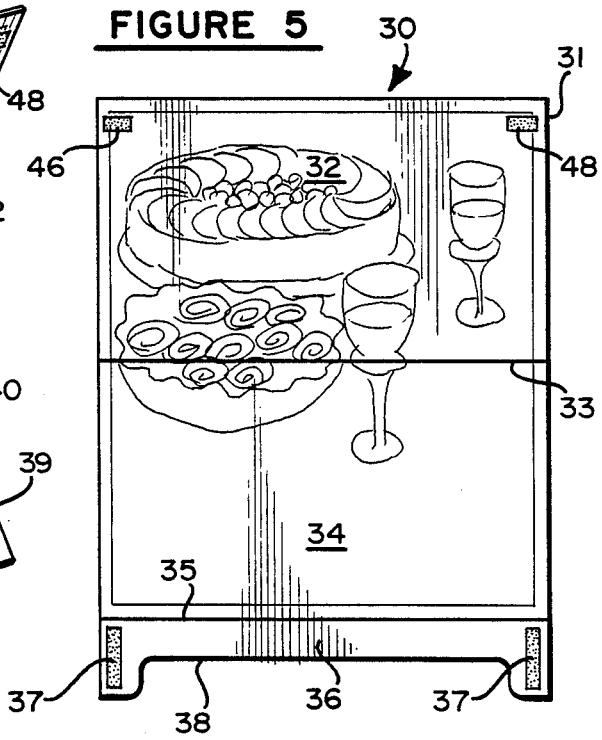
FIG. 5 is a plan view of the envelope wrapper of FIG. 4 disposed in an opened flat position.

Referring to FIGS. 4 and 5, it will be seen that the wrapper 30 is a rectangular sheet having straight side edges 31. It is divided into three panels similar to wrapper panel 10. Wrapper panel 32 is connected along fold line 33 to central panel 34. Both panels are of the same width, and both of which have an inside surface on which printed advertising material is contained.

The central panel 34 is connected along fold line 35 to the pocket panel 36. The fold line 35 forms a lower periphery of the folded wrapper.

In this modification, the pocket panel 36 is undercut along its central section at 38 to provide greater viewing areas for the insert material contained within the pocket. The pocket panel 36 is held in position against central panel 34 by the glue strips 37 which are positioned on the upstanding side sections 39 of the pocket panel. The side sections 39 engage the edges of the insert 40 and hold it in position.

The interior surface of the flap panel 32 contains glue strips 46 and 48 which hold the flap panel in closed position against the corners of the cover panel 36.

A modification of the envelope wrapper assembly of FIG. 1, is shown in FIGS. 6 to 8, in which a viewing window is providing in the flap panel of the envelope wrapper.

The wrapper generally indicated at 50 is rectangularly shaped having straight side edges 51, and is subdivided as the wrapper of FIG. 1, into three panel sections.

The wrapper panel 52 has printing 53 on its exterior surface and has an oval-shaped view window 54. The flap panel 52 is connected to the central base panel 56 along fold line 55 which forms the upper periphery of the wrapper assembly when it is closed. The pocket panel 58 is folded about fold line 57 so as to overlie the interior surface of central panel 56 and is affixed thereto by adhesive strips 59.

An additional protective transparent piece 60 is attached along a glue strip 62 to the flap panel 52 as shown in FIGS. 6 and 7. The adhesive retaining strips 66 and 68 on the flap panel 52 engage the outer folded surface of the pocket panel 58 holding the flap panel against the pocket panel and to hold the assembly closed.

The pocket panel has a one sheet piece 64 containing printing 66, and the sheet is positioned so that it can be seen through the window 54 of the flap panel 52 when the assembly is closed. This can be seen in FIG. 8 which shows a plan view of the closed completed envelope wrapper assembly.

With respect to all of these modifications the width of the pocket panel is determined by its function of providing enough support to hold the inserts in position during handling.

In addition, the lateral length of the inserts with respect to the distance between the adhesive strips forming the pocket can be brought to within one quarter of an inch of the dimension. This provides a distinct advantage in that the inserts when placed within the pocket will not change or shift position to any great degree laterally. This is of particular importance when their is a window configuration in the flap as shown in FIG. 6, requiring that the printed material of the insert be aligned with the window opening in the envelope flap.

It should also be noted that the envelope wrapper assembly is not limited to just several sheets of insert material. As many as 8 sheets of insert material can be used with this type of wrapper assembly, without creating any difficulty in packaging and fabrication.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A relatively flat, thin, in-line printed envelope wrap and insert advertising assembly, comprising:
   (a) a thin, printed paper sheet constituting an outer wrap having a central panel, a closing flap panel, and a pocket panel,
   (b) the pocket panel being of substantially less width than the central panel and folded thereover along a single common fold line which constitutes a lower outer edge of the wrapper,
   (c) the pocket panel and the central panel side edges being aligned and held together along their side edges by an intermediate adhesive layer strip engaging the opposed faces to form a substantially shallow paper insert retainer pocket,
   (d) a wide flap panel approximately the same width as the central panel and folded thereover along a single common fold line which constitutes the upper edge of the wrapper,
   (e) the flap panel overlying both the uncovered surface of the central panel and the pocket panel so as to close the wrapper, the side edges of all the panels being in alignment, and the flap panel being held in closed position by adhesive,
   (f) the inner surface of the flap panel having printing thereon which is visible when the closed wrapper is opened by lifting the flap panel,
   (g) a plurality of thin flat different printed paper insert sheets contained in the pocket which are less in length than the lateral distance between the adhesive layer strips such that the clearance between their side edges and the adhesive strips will preclude binding and lateral shifting while their width is substantially greater in width than the pocket panel, the relative pocket panel and insert dimensions being such that inserts are both supported within the insert retainer pocket and can readily be grasped and removed.

2. The printed envelope wrap and paper insert assembly as set forth in claim 9, wherein:
   (a) the pocket panel has an undercut central section extending across most of its length parallel to the fold line.

3. The printed envelope wrap and paper insert assembly as set forth in claim 9, wherein:
   (a) the pocket contains several inserts of different size which extend upwardly from the pocket and are of different widths.

4. The printed envelope wrap and paper insert assembly as set forth in claim 9, wherein:
   (a) the flap panel has a central cut-out window.

5. The printed envelope wrap and paper insert assembly as set forth in claim 4, wherein:
   (a) an additional transparent sheet is secured to the interior surface of the flap panel and extends over the window.

6. The printed envelope wrap and paper insert assembly as set forth in claim 1, wherein:
   (a) the lateral length of the paper insert sheets are approximately ½ inch less than the distance between the adhesive strips.

* * * * *

UNITED STATES PATENT AND TRADEMARK OFFICE

CERTIFICATE OF CORRECTION

PATENT NO. : 4,936,769

DATED : June 26, 1990

INVENTOR(S) : Donald Schoenleber

It is certified that error appears in the above-identified patent and that said Letters Patent is hereby corrected as shown below:

Title page between Items [76] and [21], insert

[73]Assignee: Webcraft Technologies, Inc.,
No. Brunswick, New Jersey

Signed and Sealed this

Tenth Day of December, 1991

*Attest:*

HARRY F. MANBECK, JR.

*Attesting Officer*

*Commissioner of Patents and Trademarks*